US007004829B2

(12) United States Patent
Keuler

(10) Patent No.: US 7,004,829 B2
(45) Date of Patent: Feb. 28, 2006

(54) FLAPPED GRINDING DISK

(75) Inventor: Josef Keuler, Bad Neuenahr-Ahrweiler (DE)

(73) Assignee: RHODIUS Schleifwerkzeuge GmbH & Co. KG, Brugbrohl (DE)

( * ) Notice: Subject to any disclaimer, the term of this patent is extended or adjusted under 35 U.S.C. 154(b) by 0 days.

(21) Appl. No.: 11/060,682

(22) Filed: Feb. 16, 2005

(65) Prior Publication Data

US 2005/0202768 A1 Sep. 15, 2005

(30) Foreign Application Priority Data

Mar. 12, 2004 (DE) ..... 20 2004 004 027 U

(51) Int. Cl.
*B24D 15/00* (2006.01)

(52) U.S. Cl. ..... 451/466; 451/488; 451/527; 451/548

(58) Field of Classification Search ..... 451/466, 451/465, 488, 526, 527, 528, 540, 548
See application file for complete search history.

(56) References Cited

U.S. PATENT DOCUMENTS 2,749,681 A 6/1956 Reidenbach
2,907,147 A * 10/1959 Hall et al. ..... 451/527
3,742,655 A * 7/1973 Oliver ..... 451/488
6,582,289 B1 * 6/2003 Eisenberg ..... 451/548

FOREIGN PATENT DOCUMENTS

DE 17 85 084 U 10/1958

OTHER PUBLICATIONS

German Search Report, from German Utility Model Application No. 20 2004 004 027.1 dated May 3, 2004.

* cited by examiner

*Primary Examiner*—Jacob K. Ackun, Jr.
(74) *Attorney, Agent, or Firm*—GraybealJacksonHaley LLP

(57) ABSTRACT

The flapped grinding disk comprises a disk- or plate-shaped support and grinding flaps which overlap each other on the support in the manner of shingles and which are secured in an adhesive bed. Apertures are cut away on the periphery of the flapped grinding disk, the apertures have approximately the form of a part of an annulus with a front edge and an edge at the rear in the direction of rotation of the grinding disk and at least the edge of the apertures that is at the rear in the direction of rotation of the grinding disk runs approximately radially. The grinding flap adjoining the rear edge of the aperture can form a ramp. The front edge of the apertures can also run approximately radially. The radial depth of the apertures can be equal to the radial extent of the grinding flaps, so that no remnants of grinding flaps remain at the inner edge of the apertures.

9 Claims, 1 Drawing Sheet

FLAPPED GRINDING DISK

CROSS-REFERENCE TO RELATED APPLICATION

Figure 1:
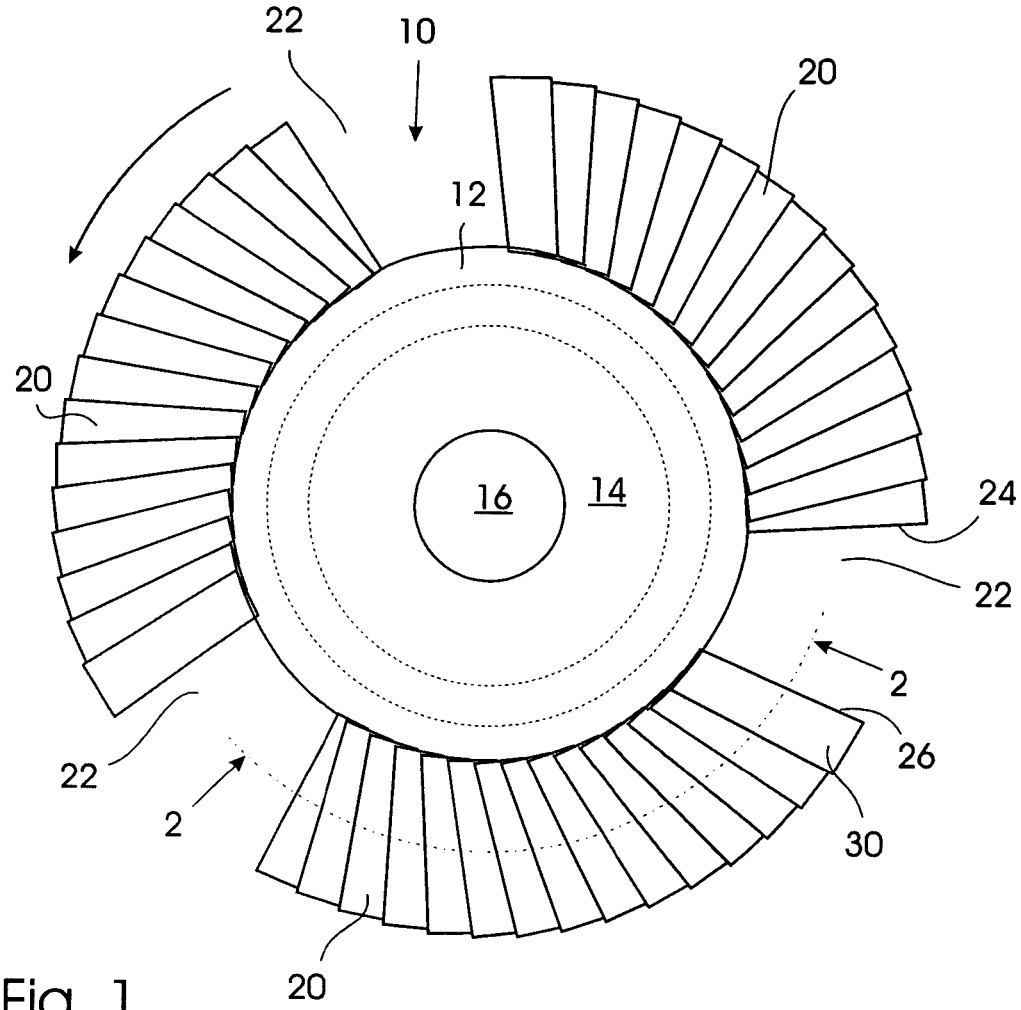

This is a utility application which claims, under 35 USC §119, priority to co-pending German Model Utility Application No. 20 2004 004 027.1, filed on 12 Mar. 2004, which is incorporated herein by reference.

BACKGROUND OF THE INVENTION

The invention relates to a flapped grinding disk or wheel with a disk- or plate-shaped support and with grinding blades (flaps) which are fixed overlapping each other in the manner of scales or shingles on the support in an adhesive bed. Apertures are cut away on the periphery of the flapped grinding disk.

The apertures make it possible to constantly monitor the grinding result during grinding. Furthermore, heating of the machined workpiece is reduced by the apertures.

In such a flapped grinding disk known from DE-U-202 14 389 the apertures are segment-shaped, i.e. they are cut off from the periphery by a cut which is guided along a chord.

A similar flapped grinding disk is also known from U.S. Pat. No. 6,007,415, the aperture being able to have any form and segment-shaped apertures specifically again being described.

Flapped grinding disks with a circular periphery and without inspection apertures are known from DE-U-92 05 471, DE-A-40 31 454, DE-A-44 30 229 and WO99/16583.

Grinding and cutting-off disks in which granular abrasive is applied direct to the disk- or plate-shaped support and in which inspection apertures are provided are known from DE-A-1 652 912, DE-U-298 02 791 and WO00/35634. The inspection apertures are circular openings in the support or cuts with rounded flanks provided at the periphery.

SUMMARY OF THE INVENTION

The object of the invention consists in a flapped grinding disk in which the result of the grinding over the entire grinding layer on the machined workpiece surface can be continuously observed.

According to the invention this object is achieved by the apertures being approximately trapezoidal or having the form of part of a circular ring (annulus), at least the edge of the apertures that is at the rear in the direction of rotation of the grinding disk running approximately radially.

The rear edge of the apertures need not run exactly radially, deviations of plus/minus approximately 15° being permissible.

The result of this course of the rear edge of the inspection aperture is that no cut grinding flaps or cut-off remnants of grinding flaps remain there which, during grinding, could become detached from the adhesive bed in which the grinding flaps are fixed on the support.

The grinding flaps overlap each other three- or fourfold in the manner of shingles. The three or four cut grinding flaps are removed at the rear edge of the aperture, as they are no longer fully anchored in the adhesive bed. The first grinding flap remaining there thus forms a ramp which contributes to a smooth running of the grinding disk.

The front edge of the aperture also preferably runs approximately radially so that the apertures are approximately trapezoidal. The result is that no parts of grinding flaps that could be torn off during grinding remain at the front edge of the inspection aperture either.

This embodiment of the invention, in which both the front edge and the rear edge of the apertures run approximately radially, produces a field of vision opened by the apertures which allows the grinding result to be seen equally well over the entire radial extent of the apertures.

The radial depth of the inspection apertures is preferably equal to the radial extent of the grinding flaps, so that no remnants of grinding flaps remain at the inner edge of the apertures. In flapped grinding disks with a diameter of 115 or 125 mm, the grinding flaps have a length of e.g. 20 or 25 mm and the apertures accordingly also have a radial depth of 20 or 25 mm. It was shown that the security of the grinding disk as a whole and that of the disk- or plate-shaped support are hardly impaired by such apertures. A slight reinforcement of the support suffices.

The radial depth of the inspection apertures can also be somewhat smaller than the radial extent of the grinding flaps, so that this inner edge is also entirely covered with grinding flaps. The remnants remaining there of the grinding flaps still have a sufficient radial extent to prevent them from being torn off during grinding. In general, 5 to 8 mm suffices for this. Also this will leave 5 to 8 mm of the grinding flaps which overlap the first grinding flap, which joins onto the rear edge of the aperture.

Preferably two or three such inspection apertures are provided, distributed uniformly on the periphery of the grinding disk. Three inspection apertures are particularly preferred. The additional loss of grinding flaps at the trailing edge of the inspection apertures is thereby kept within a justifiable limit.

Taken together, the apertures preferably extend over an angle of 60° to 100°, in particular 75°. If there are three apertures, each aperture then has a width of approximately 25°.

A further advantage of the flapped grinding disk according to the invention is that the tendency of the grinding tool to drift on the workpiece is greatly reduced.

The large radial extent of the inspection apertures results in an optimum inspection of the entire grinding area so that a workman is enabled to minimize the sizes of the ground area and the grinding volume. This is advantageous in particular when grinding weld seams.

Surprisingly it was shown that, in spite of the size of the inspection apertures and the radial course of the trailing and optionally also front edges of the apertures, there is no danger of the grinding disk hooking into unevennesses in the workpiece. For example it is possible to grind off protruding nail heads or screw heads without difficulty.

The circular outer area of the support can drop away slightly to the outside or be plane. Correspondingly the grinding layer formed by the grinding flaps can also drop away slightly to the outside or be plane.

The flapped grinding disk according to the invention can be manufactured using a support comprising a multilayered fibre support, e.g. glass fibre cloth and jute, metal materials, e.g. iron or aluminium, or plastic. The support is applied in a semi-automatic machine such as is customary for the manufacture of flapped grinding disks. An adhesive (one- or two-component adhesive), e.g. an epoxide adhesive, is applied to one side of the support. Then the grinding flaps are fitted, cut off and pressed on. A plurality of such semi-finished flapped grinding disks is stacked on a mandrel of e.g. 500 mm in length and cured for four to five hours at approx. 120° C. Finally opposite-facing apertures shaped like a part of an annulus are cut out by means of diamond cutting-off disks or punch out, saw out or grind two further.

The supports can also be coated separately. To this end, the circular support is clocked corresponding to the distance between segments in direction of rotation. The exact alignment of the grinding flaps is reached after the support has been completely covered by pressing on with a female mould.

SHORT DESCRIPTION OF THE DRAWINGS

An embodiment of the invention is explained below with reference to the drawing. There are shown in:

FIG. 1 the flapped grinding disk in a top view; and

Figure 2:
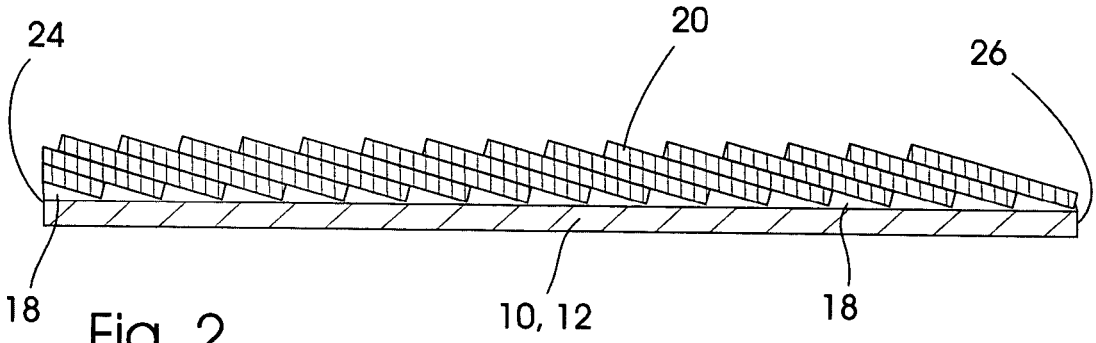

FIG. 2 the flapped grinding disk of FIG. 1 in a section along 2—2.

DETAILED DESCRIPTION OF THE INVENTION

The flapped grinding disk shown in FIG. 1 has a plate-shaped support 10 with a circular outer area 12 and a recessed or cranked inner area 14, a clamping bore 16 being located in the middle of the inner area 14, with which the flapped grinding disk can be clamped on the clamping pin of an angle grinder. The circular outer area 12 drops away slightly to the outside.

Applied to the plane outer area 12 is an adhesive bed 18, which is equipped with a plurality of grinding flaps 20, which overlap each other in the manner of shingles, so that it is only ever the end area, a few millimeters wide, of each grinding flap 20 that is exposed. The part which is lying in front in the direction of rotation is covered by the grinding flap or flaps 20 lying in front. The individual grinding flaps 20 consist of a base fabric, to which a granular abrasive is applied. The grinding flaps 20 have a radial extent of approximately 20 to 60%, e.g. 40% of the radius of the flapped grinding disk. Corresponding to the inclination of the outer area 12, the grinding flaps 20 also drop away to the outside.

The flapped grinding disk has three apertures 22, arranged at angular distances of 120°, which have the form of a part of an annulus and each cover an angle of approximately 25°. The radial depth of the apertures 22 is equal to the radial extent of the grinding flaps 20, so that the inner edge of the apertures 22 is not equipped with grinding flaps 20.

The direction of rotation of the flapped grinding disk is indicated. Each aperture 22 has a front or leading edge 24 and a rear or trailing edge 26 in the direction of rotation. The rear edge 26 of each aperture 22 travels approximately radially or parallel to the longitudinal extent of the grinding flap 30 attached there. Parts 28 of three or four grinding flaps remain at the rear edge 26 following the cutting out of the aperture 22. The grinding flaps 20 are anchored in the adhesive bed 18 only by the half that is in front in the direction of rotation. This front half is wholly or partially missing from these parts, so that these grinding flaps are only insufficiently secured to the support 10. These parts are therefore removed. The first grinding flap 30 at the rear edge is therefore exposed over its entire width and forms a ramp.

The front edge 24 of each aperture 22 likewise runs approximately radially or parallel to the grinding flap 20 there. Front sections of cut grinding flaps 20 lie under the trailing edge 34 of this grinding flap. As these are fully anchored in the adhesive bed 18, they are not removed.

The grinding flaps 20 each have the form of a sector with a cut-off tip, i.e., the distance between the leading edge and the trailing edge becomes smaller towards the centre of the flapped grinding disk. Furthermore the leading edge and the trailing edge do not run radially, but at an angle of approximately 10 to 15° to the radius, and the grinding flaps 20 are rotated by this angle in the direction of rotation of the flapped grinding disk, the rotation point lying approximately in the middle of the outer edge 36 of the grinding flaps. The imaginary intersection of the leading edge and trailing edge of each grinding flap 20 is thereby at a distance from the centre of the flapped grinding disk that corresponds to this angle of rotation.

EXAMPLE

The flapped grinding disk has an overall diameter of 115 mm, the inner ends of the grinding flaps lying on a circle with a diameter of 75 mm. The apertures 22, three in total, begin at a circle with a diameter of 75 mm and end at the outer diameter of 115 mm.

The flapped grinding disk has 75 grinding flaps 20, so that each grinding flap has a visible width of 4.8° or 4.82 mm at the outer periphery of the flapped grinding disk. The is radial width of the grinding layer, i.e. the length of the grinding flaps 20, is 20 mm, fully usable.

Each grinding flap has an overall width of 18 mm, and the grinding flaps 20 overlap each other fourfold.

Each aperture 22 extends over approximately five grinding flaps, i.e. 25°. At the rear edge 26 of the apertures 22 the parts where cutting has started of three grinding flaps 20 are therefore in each case additionally removed.

While corresponding flapped grinding disks without apertures have supports, which have six to eight layers of glass fibre cloth, in this example the support 10 has twelve layers of glass fibre cloth.

What is claimed is:

1. Flapped grinding disk comprising:

a disk- or plate-shaped support; and grinding flaps which overlap each other on the support in the manner of shingles and which are secured in an adhesive bed;

wherein apertures are cut away on the periphery of the flapped grinding disk, the apertures have approximately the form of a part of an annulus with a front edge and an edge at the rear in the direction of rotation of the grinding disk and at least the edge of the apertures that is at the rear in the direction of rotation of the grinding disk runs approximately radially.

2. Flapped grinding disk according to claim 1, wherein the grinding flap adjoining the rear edge of the aperture forms a ramp.

3. Flapped grinding disk according to claim 1, wherein the front edge of the apertures also run approximately radially.

4. Flapped grinding disk according to claim 1, wherein the radial depth of the apertures is equal to the radial extent of the grinding flaps, so that no remnants of grinding flaps remain at the inner edge of the apertures.

5. Flapped grinding disk according to claim 1, wherein the apertures together extend over an angle of 60° to 100°.

6. Flapped grinding disk according to claim 5, wherein the apertures together extend over an angle of approximately 75°.

7. Flapped grinding disk according to claim 1, wherein two apertures are provided, uniformly distributed on the periphery of the grinding disk.

8. Flapped grinding disk according to claim 1, wherein three apertures are provided, uniformly distributed on the periphery of the grinding disk.

9. Flapped grinding disk comprising:

a disk- or plate-shaped support; and grinding flaps which overlap each other on the support in the manner of shingles and which are secured in an adhesive bed;

wherein three apertures are cut away on the periphery of the flapped grinding disk, the apertures are approximately trapezoidal and have the form of a part of an annulus with a leading edge and a trailing edge and at least the trailing edge runs approximately radially;

wherein each of the apertures extends over an angle of approximately 25°; and wherein the radial depth of the apertures is equal to the radial extent of the grinding flaps, so that no remnants of grinding flaps remain at the inner edge of the apertures.

* * * * *